United States Patent [19]

Gladwin

[11] 4,220,192

[45] Sep. 2, 1980

[54] COMBINED ROLLER SUPPORT AND SPRAY COOLING SYSTEM FOR CONTINUOUS CASTING MOLDS

[76] Inventor: Kirk M. Gladwin, 21000 East River, Grosse Ile, Mich. 48138

[21] Appl. No.: 43,020

[22] Filed: May 29, 1979

[51] Int. Cl.[2] ..... B22D 11/124; B22D 11/128

[52] U.S. Cl. ..... 164/89; 164/442; 164/444; 164/448

[58] Field of Search ..... 164/89, 442, 444, 448

[56] References Cited

U.S. PATENT DOCUMENTS

| | | | |
|---|---|---|---|
| 3,572,423 | 3/1971 | Bick et al. | 164/442 |
| 3,930,534 | 1/1976 | Wunnenberg et al. | 164/444 X |

FOREIGN PATENT DOCUMENTS

| | | | |
|---|---|---|---|
| 920328 | 2/1973 | Canada | 164/89 |
| 830852 | 3/1960 | United Kingdom | 164/448 |

*Primary Examiner*—Robert D. Baldwin
*Attorney, Agent, or Firm*—Cullen, Sloman, Cantor, Grauer, Scott & Rutherford

[57] ABSTRACT

A combined roller support bar and spray cooling system for mounting at the open bottom of a vertically arranged molten metal continuous casting mold carries a horizontally axised roller which engages and guides the cast slab portion emerging from the mold. The bar is provided with a longitudinal passageway into which cooling water is flowed. The water flows out through numerous transverse passageways formed in the bar, which terminate in nozzle ends oriented to spray the water above and below the roller against the adjacent slab surface for cooling purposes. The spray water cools the interior of the support bar, as it flows through the passageways, to prevent heat caused warping and twisting and thereby maintain the pre-set, accurate orientation of the roller and nozzles.

7 Claims, 6 Drawing Figures

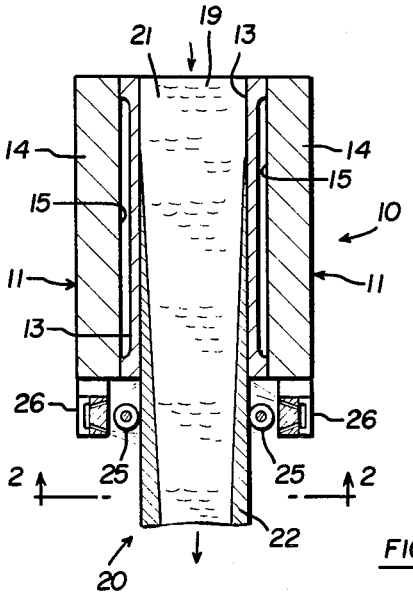
FIG. 1
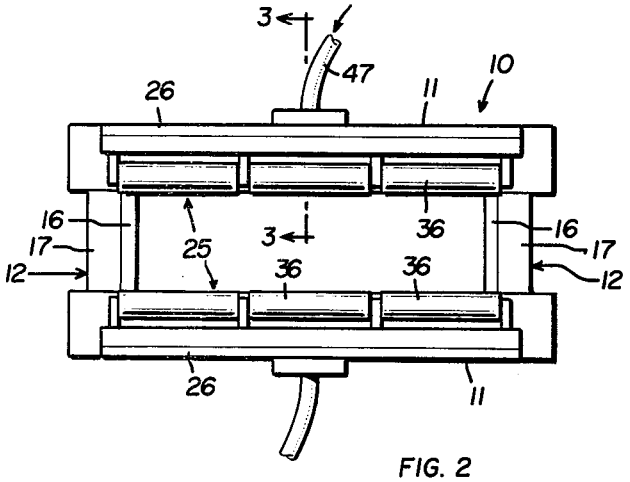
FIG. 2
FIG. 3
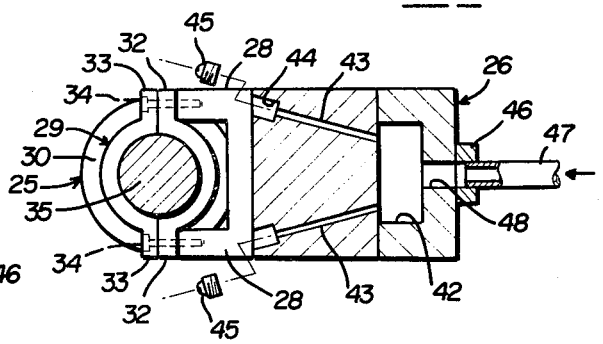
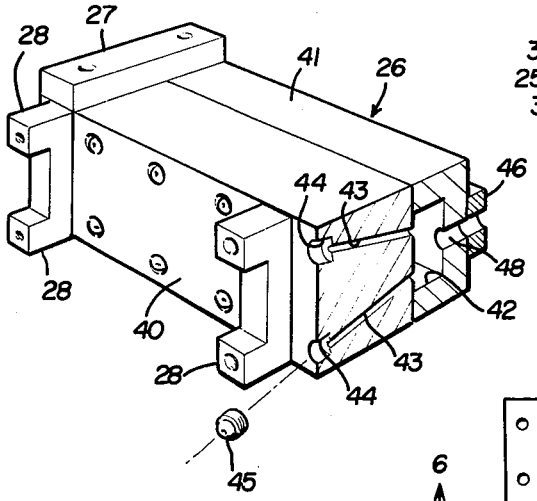
FIG. 4
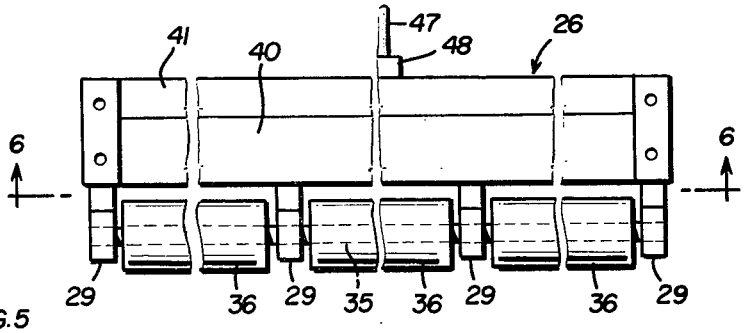
FIG. 5
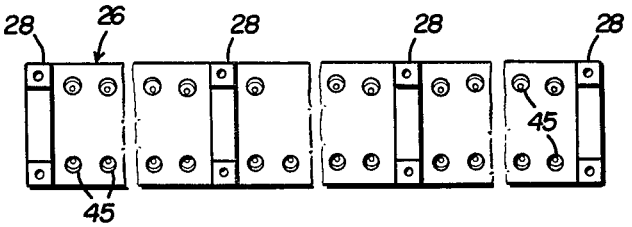
FIG. 6

COMBINED ROLLER SUPPORT AND SPRAY COOLING SYSTEM FOR CONTINUOUS CASTING MOLDS

BACKGROUND OF INVENTION

In the continuous casting of molten metal, such as steel, the metal is poured into the open, upper end of a vertically arranged, generally rectangular in cross-section mold where the metal begins to solidify. Since the mold walls, which make up the mold, are typically cooled, a solidified skin forms upon the metal. The solidifying slab emerging downwardly from the open bottom end of the mold, consists of a solidified skin surrounding a molten interior.

As the slab progresses downwardly, away from the mold, it is further cooled until ultimately it is solidified throughout. An example of the type of mold utilized for this purpose is illustrated in U.S. Pat. No. 4,124,058, issued to Floyd R. Gladwin on Nov. 7, 1978, and U.S. Pat. No. 3,978,910 issued to Floyd R. Gladwin on Sept. 6, 1976.

It is conventional to arrange rollers beneath the casting mold to engage the faces of the slab, especially the opposed wider faces of a rectangular shaped slab, to both guide and maintain a pressure upon the slabs during the continued solidification beneath the mold. To assist in the solidification procedure, water sprays are typically arranged below the mold to spray cold water upon the slab surfaces for cooling purposes.

In the type of mold construction to which the invention herein relates, horizontally axised rollers are located closely adjacent to the bottom walls of the continuous casting mold so that the rollers engage the opposed surfaces of the emerging slab portion. These rollers are supported within bearings which are mounted upon rigid, elongated bars that are fastened either to the lower portions of the mold or to some adjacent support structure. In addition, a water header or conduit is located near the bar and short lengths of tubing extend from such conduit inwardly, i.e., towards the slab. The inner ends of these tubes are normally provided with conventional nozzles which spray the water against the slab surfaces and the rollers.

The use of separate spray nozzle equipment for cooling the emerging slab is known and variations of such equipment are illustrated in U.S. Pat. No. 3,515,202 issued to Klaus Bick, et al. issued June 2, 1970, U.S. Pat. No. 3,930,534 to Klaus Wunnenberg on Jan. 6, 1976 (showing end rollers and spray arrangements), U.S. Pat. No. 3,931,848 issued to Markus Schmid on Jan. 13, 1976 and U.S. Pat. No. 4,033,404, issued to Markus Schmid on July 5, 1977. In each of these prior patents, the spray equipment includes short spray tubes upon which suitable nozzles are mounted for spraying cooling water upon the surfaces of the slab just beneath the lower end of the continuous casting mold.

In the conventional type of construction, the water conduit or conduits, if more than one is used, and the inwardly directed water carrying tubes with the nozzles, are typically fastened to the bar which carries the roller support bearings and rollers.

In the foregoing construction, because of the substantial heat from the slab, there is a tendency for the roller support bars, on the opposite sides of the slab, and also on the opposite ends if additional rollers are used there, to warp out of longitudinal alignment and also to twist. If a sufficiently heavy bar is utilized, the warping and twisting tendency is minimized, but nevertheless still tends to occur. This causes misalignment of the roller support bearings and the rollers themselves. It also tends to misdirect or bend out of proper orientation, the tubes carrying the water for the spray purposes.

In addition, because of the substantial heat in the area, if there is any short stoppage of water flowing through any one of the tubes, that tube tends to bend out of proper alignment. Thus, there is a general tendency for the support bar and the roller and the cooling system to become misaligned. In addition, from time to time, accidents occur wherein molten metal overfills the mold and flows down alongside of the mold. When this occurs, the molten metal tends to solidify upon the water spray tubes and conduit and if the condition is severe enough, will ruin these tubes and the spray system, thereby necessitating scrapping the system and replacing the spray system with a new construction.

Consequently, the invention herein is concerned with improving the cooling of the roller support bar and protecting the spray system and interrelating the support bar and the spray system so that one tends to protect the other against misalignment or molten metal spill-overs.

SUMMARY OF INVENTION

The invention herein contemplates forming the spray system within the roller support bar, that is, with the conduit and the spray nozzle tubing formed within the interior of the support bar, whereby the spray water continuously cools the support bar to prevent warping or twisting thereof, and simultaneously the support bar construction protects the spray system construction.

In the invention herein, the support bar is made hollow by forming a longitudinal passageway therein which acts as a spray water carying conduit or header. Transverse passageways formed within the support bar act as the spray tubes so that the spray water is flowed into the hollow support bar and out through the transverse passageways which terminate in nozzle-like configurations. Hence, the support bar and spray system are, for all practical purposes, one piece. As long as the support bar is dimensionally stable, that is, resists against twisting or bending or warping due to heat, then the pre-set or pre-formed spray nozzle construction maintains its orientation. Moreover, because the spray system is within the support bar, spill-overs of molten metal will not effect the spray system or ruin it, as was the case in the past. Meanwhile, the spray water is utilized to continuously cool the interior of the support bar to prevent its being effected by the ambient heat due to the casting. Consequently, the bar does not warp or twist, as in the past, and the rollers carried by the bar likewise maintain their pre-set dimensional accuracy.

In addition, the support bar may be properly machined and assembled upon the mold apparatus as a unit, as opposed to the separate parts assembly required in the past for separate spray systems. Thus, the handling and assembly and labor requirements are all substantially reduced in utilizing the improved support bar herein.

Other objectives and advantages of this invention will become apparent upon reading the following description, of which the attached drawings form a part.

DESCRIPTION OF DRAWINGS

FIG. 1 is a cross-sectional, schematic, elevational view of the continuous casting mold and the slab formed therein.

FIG. 2 is a bottom, plan view looking upwardly, in the direction of arrows 2—2 of FIG. 1.

FIG. 3 is an enlarged, cross-sectional view, taken in the direction of arrows 3—3 of FIG. 2, and illustrating the varying mounting of the roller upon the support bar.

FIG. 4 is a fragmentary, enlarged, perspective view of the support bar.

FIG. 5 is a top, plan view of a support bar and roller, and

FIG. 6 is a elevational view of the support bar illustrated in the direction of arrows 6—6 of FIG. 5.

DETAILED DESCRIPTION

The continuous casting mold 10 is formed of opposed side walls 11 (see FIG. 1), between which are clamped opposed, narrow, end walls 12 (see FIG. 2).

Each of the side walls are made up of inner plates 13 which are secured to outer plates 14. Cooling passageways or chambers 15 are formed within the inner plates 13, which inner plates may be made of a heat conductive material, such as copper or the like, so that water directed through the cooling chambers or passageways 15 carry away the heat of molten metal.

The narrow end walls 12, are also formed of inner, heat conductive plates 16 which are mounted upon outer support plates 17. Although not illustrated, the inner plates 16 may also be provided with water cooling chambers or the like.

The side walls and end walls make up or define a roughly rectangular in cross-section casting cavity 19 within which the molten metal is cast. As shown in FIG. 1, the molten metal forms a slab 20 when it emerges from the bottom of the vertically arranged mold. Molten metal 21 is poured into the upper end of the mold as illustrated by the arrow in FIG. 1. The molten metal contacts the cooled inner plates 13 and 16 to produce a solidified skin 22 on the surface of the slab.

Withdrawal of the slab from the bottom of the mold at a predetermined rate, results in the skin surrounding a molten interior. As the slab progressively moves, it is further cooled until the skin solidifies inwardly sufficiently so that the entire interior of the slab is solidified.

As the slab emerges from the bottom of the mold, it is desirable to support the still relatively thin skin while cooling the slab. The support may be provided by opposed, horizontally axised rollers 25, as shown schematically in FIG. 1. These rollers are rotatably supported upon roller support bars 26. The bars are connected by appropriate end brackets 27 or the like either to the bottom of the side wall outer plates 14 or to some other appropriate support structure. The mechanical connection between the bars and either the walls or the other structure, is known and forms no part of this invention and therefore is illustrated only schematically here. Moreover, the rollers may be provided at the narrow ends of the slab in addition to being provided at the broader faces of the slab.

A number of roller bearing brackets 28 are secured upon the inner vertical faces of each of the support bars 26, i.e., the faces that are directed towards the mold cavity. Suitable roller bearings 29 are fastened upon these brackets. Although any suitable conventional bearings may be used, for illustration purposes, the bearings are shown as being of a journal-type bearing split into two parts, i.e., outer part 30 and inner part 31 which have overlapping flanges 32 and 33 that are fastened together and to the roller bearing brackets 28 by means of machine screws 34.

A long roller shaft 35 extends through the bearings 29. Mounted upon each such shaft, are a series of roller sections 36, such as three sections, which make up the overall roller 25.

The support bar 26 may be of substantial size, such as on the order of five to seven feet in length and roughly six inches by six inches in cross-sectional dimension. Preferably, it is formed of two sections, namely a forward or main body section 40 (see FIG. 4) and an outer or cover section 41 which is provided with a channel to form an internal, longitudinal passageway 42 when the two sections are secured together, as by welding or by mechanical fasteners. Transverse passageways 43 are formed in the main body section 40 of the bar and these passageways terminate in enlarged nozzle receiving ends 44.

Any suitable conventional spray nozzle 45 may be fastened, as by threaded engagement, within the nozzle receiving end portion 44 of each of the transverse passageways.

A water pipe fitting 46 is secured to the cover section 41. A water pipe 47, connected to a pressurized water source, such as city water or to a tank or reservoir with a pump for pumping water continuously through the water pipe 47 (not shown), provides water through an opening 48 into the longitudinal passageway 42 in the roller support bar.

In operation, molten metal is poured into the open upper end of the mold and gradually solidifies, i.e., forms the skin, within the mold. The solidifying slab exits or emerges through the bottom open end of the mold. At the bottom of the mold, the opposed rollers accurately hold the emerging portions of the slab while the slab further solidifies and at the same time, water is sprayed upon the slab. The water is sprayed by means of the flow of water passing through the internal longitudinal passageway 42, then through the transverse passageways 43 and out through the nozzles 44. The constant flow of cold water through the passageways cools the interior of the massive bar, which may be formed of a suitable steel material, so as to keep the bar sufficiently cooled to avoid distortion and to maintain its dimensional stability. Thus, the sprays, which are angularly arranged so as to spray above and below the rollers are of predetermined orientation and will not warp or bend or otherwise move out of predetermined initial position.

The number of spray nozzles may be varied, depending upon the requirements of the particular casting operation. However, it is desired that a relatively large number of these be used and they may be either aligned as indicated in FIG. 6, or they may be alternated (not illustrated) by having an upper and a lower row, which are offset horizontally relative to each other so as to form an alternating pattern rather than a consistent aligned pattern as in FIG. 6.

Having fully described an operative embodiment of this invention, I now claim:

1. In a continuous slab casting apparatus including a mold having side and end walls and open upper and bottom ends for casting molten metal within the upper end of the mold and withdrawing the cooling slab downwardly from the bottom of the mold, and having at least one approximately horizontally axially supported roller arranged at the bottom of the mold to engage the adjacent face portion of the solidifying slab just below where it emerges from the mold, with the roller being rotatably mounted upon a roughly horizontally arranged elongated bar which is secured at the bottom edge of one of the mold walls, and with water spray nozzle means arranged at the vicinity of the roller for water cooling the adjacent slab face portion and roller, the improvement comprising:

a generally longitudinal hollow passageway formed within the support bar, and a number of generally transverse passageways also formed within the support bar and extending between an opening into the longitudinal passageway and the surface of the bar which is closely adjacent to the roller, with the end portions of the transverse passageway located at the roller forming spray nozzles oriented for directing a water spray upon the roller and above and below the roller against the adjacent slab surface;

and means for flowing water continuously through the bar longitudinal passageway and then through the transverse passageways for spraying and for continuously internally cooling the bar and thereby maintaining its stability against warping and bending due to heat so as to continuously maintain the roller alignment and spray nozzle alignment.

2. A contruction as defined in claim 1, and said transverse passageways being directed at angles to the horizontal, with the nozzle end openings being vertically offset relative to the roller axis, so that the nozzle orientations are pre-set, wherein at least some nozzles are oriented to direct the water spray above the roller and others are oriented to direct the water spray below the roller.

3. A construction as defined in claim 1, and including a second roller rotatably mounted upon a support bar located opposite to the first mentioned roller and bar for engagement with the opposite face of the slab and for guiding the slab between the two rollers;

and said second bar being provided with similar longitudinal and transverse passageways for similarly cooling the bar and maintaining its dimensional stability for maintaining the roller and spray nozzle alignments and for spraying water upon the opposite slab face.

4. A combined roller support bar and water spray system for the bottom of a molten metal continuous casting mold for supporting and maintaining the alignment of both a roller arranged to engage against a continuously cast slab and a spray nozzle means oriented to direct a cooling water spray against said slab, comprising:

an elongated, generally horizontally arranged bar and a roller arranged generally axially parallel to and horizontally spaced from said bar, and means for rotatably mounting the roller upon the bar;

a generally longitudinal passageway extending through the bar for connection to a water supply source which continuously feeds cooling water into said longitudinal passageway;

a number of generally transversely arranged passageways formed in the bar, each having one end opening into the longitudinal passageway for receiving water therefrom, and each also opening at the surface of the bar near the roller and forming nozzle ends for spraying the water from the bar transversely across the roller and upon the portion of the continuously cast slab against which the roller is arranged to engage;

whereby the dimensionl stability of the bar against warping and twisting due to heat, and consequently the orientation of the roller and nozzle ends are continuously maintained by the internal cooling effect of the spray water flowing through the bar passageways.

5. A construction as defined in claim 4, and said transverse passageways being arranged at an angle relative to the axis of the roller so that the passageway nozzle ends are vertically offset relative to the roller with some nozzle ends being above and others being below the roller axis, for thereby orienting the nozzle ends to spray water in a generally horizontally direction, but respectively above and below the roller.

6. A method for maintaining the alignment of a slab support roller and the cooling spray nozzles located at the bottom of a molten metal continuous casting mold formed of opposed side walls and end walls and with an open upper end into which molten metal is poured for casting within the mold, and an open lower end through which the solidifying cast slab is downwardly withdrawn from the mold, and with a roller located at the bottom of one of the mold walls for engaging a face of the slab just beneath the mold, the roller being rotatably mounted upon an elongated support bar which is secured beneath the mold wall, and with water cooling spray nozzles located adjacent the roller arranged for spraying water upon the slab in the vicinity of the roller and adjacent the bottom of the mold, comprising:

forming a hollow passageway, generally lengthwise through the support bar and forming a number of generally transverse passageways extending from the lengthwise passageway to the bar surface closest to the roller and cast slab and terminating in open ends forming spray nozzles;

continuously flowing water into and through the lengthwise passageway and out through the transverse passageways with the water flow through said passageways continuously cooling the support bar internally, to prevent warping and twisting of the bar due to heat, and with the water spraying upon the slab and the roller for simultaneously cooling both, wherein the dimensional stability of the bar due to the continuous water flow cooling maintains the alignment of the roller mounting and the roller and also maintains the pre-set alignment of the cooling spray nozzles.

7. A method as defined in claim 6 above, and including forming similar lengthwise and transverse passageways within a second roller support bar upon which a second roller is mounted, and located at the bottom of the mold at the opposite face of the slab, i.e., for opposing the first mentioned roller and roller support bar;

and continuously flowing water through said passageways for cooling said second bar and spraying water upon the slab and roller for thereby maintaining accurate pre-set opposed roller alignments on the opposite faces of the slab, and for accurately maintaining the spray nozzle locations and spray cooling flow.

* * * * *